United States Patent [19]

Krautkremer et al.

[11] 4,418,633

[45] Dec. 6, 1983

[54] APPARATUS FOR CONTROLLING A WATERCRAFT

[75] Inventors: Franz Krautkremer, Spay; Juergen Issleib, Hamburg, both of Fed. Rep. of Germany

[73] Assignee: Schottel-Werft, Josef Becker GmbH & Co. KG, Spay, Fed. Rep. of Germany

[21] Appl. No.: 250,486

[22] Filed: Apr. 2, 1981

[30] Foreign Application Priority Data

Apr. 9, 1980 [DE] Fed. Rep. of Germany ..... 3013654

[51] Int. Cl.[3] ..... B63H 25/00

[52] U.S. Cl. ..... 114/144 E; 114/144 R; 440/53; 74/109

[58] Field of Search ..... 440/53, 58, 60, 63, 440/79, 80; 114/144 E, 144 R, 150, 151; 244/225, 234, 237, 52; 74/109, 471 R

[56] References Cited

U.S. PATENT DOCUMENTS

| | | | |
|---|---|---|---|
| 1,313,680 | 8/1919 | Fairey | 244/225 |
| 3,756,188 | 9/1973 | Smith | 440/60 |
| 4,088,087 | 5/1978 | Nitta | 114/144 R |
| 4,154,415 | 5/1979 | Harris et al. | 244/225 |
| 4,220,111 | 9/1980 | Krautkremer et al. | 440/53 |
| 4,271,780 | 6/1981 | Etoh | 114/144 E |

FOREIGN PATENT DOCUMENTS

| | | | |
|---|---|---|---|
| 465131 | 5/1937 | United Kingdom | 244/225 |

*Primary Examiner*—Trygve M. Blix
*Assistant Examiner*—Thomas J. Brahan
*Attorney, Agent, or Firm*—Flynn, Thiel, Boutell & Tanis

[57] ABSTRACT

An apparatus for driving and controlling a watercraft or the like having at least one pair of steerable propellers, the steerable propellers of each pair being located substantially symmetrically on opposite sides of the center line of the watercraft, such center line extending through the center of lateral resistance of the watercraft. A control element is provided for carrying out control movements in two degrees of freedom. Each control movement acts for remote control of the steerable propellers through transmitters corresponding respectively to such steerable propellers. Movement of the control element in one degree of freedom effects a rotation about an axis for controlling, through the transmitters, a synchronous pivoting of the servo propellers of each pair. Movement of the control element in the second degree of freedom effects movement of a rack element for controlling, through the same transmitters, an oppositely directed pivoting of the servo propellers relative to one another.

5 Claims, 5 Drawing Figures

3
22
2
20'
4
1
25
24
22A
23
22B
26
19
21
20
43
39
21
21
21
42
40
16
38
37
41
30
21
36
32
15
35
31
29
28
27
21
21
21
34
33

| 100 | 101 | 102 | 103 | 104 | 105 |
|---|---|---|---|---|---|
| 111 | 0° | 1 | | | |
| 112 | 0°...360° | 1 | | | |
| 113 | 0° | 2 | | | |
| 114 | 45° | 2 | | | |
| 115 | 90° | 2 | | | |
| 116 | 45° | 2→3 | | | |
| 117 | 90° | 2→1 | | | |
| 118 | | 3 | | | |
| 119 | 180° | 2 | | | |
| 120 | 0° | 4 | | | |

Fig. 3

APPARATUS FOR CONTROLLING A WATERCRAFT

FIELD OF THE INVENTION

The invention relates to an apparatus for controlling a watercraft or the like having at least one pair of steerable propellers, the steerable propellers of each pair being located substantially symmetrically on opposite sides of the center line of the watercraft.

BACKGROUND OF THE INVENTION

An apparatus for controlling of ships with two steerable propellers is already known, in which a lever swingable in two coordinates is used and which effects the pivoting motion of the steerable propellers through transmitter, phase discriminator, amplifier and servomotor. The known apparatus is complicated and a movement of the ship without rotation (called traversing) into any desired direction is not possible (U.S. Pat. No. 3,976,023).

The basic purpose of this invention is to provide an apparatus of the above-mentioned type, which is simpler and less expensive and with which traversing can be done.

The basic purpose of the invention is attained with an apparatus in which movement of a control element in one of two degrees of freedom effects a rotation about an axis for controling through transmitters a synchronous pivoting of the steerable propellers of each pair and wherein movement of the control element in the second degree of freedom effects movement of a rack element for controlling through the same transmitters an oppositely directed pivoting of propellers relative to one another. This apparatus can be further developed advantageously by providing transmitters which each comprise two members movable relative to one another, such as electrical function generators incorporating a spool or the like and a brush or the like in electrical signal passing relation therewith, and wherein the control elements acts during its rotation through gears or the like onto one member of the transmitter and the control element acts during its movement of such rack element onto the other member of the transmitter. The transmitter and receiver for the remote control can be operated electrically or hydraulically or pneumatically or in a combination. The elements of such remote controls are known.

A different advantageous development of the invention is provided wherein the transmitters each comprise two members which are movable relative to one another, for example electrical function generators including a spool or the like and a brush or the like in electrical signal passing relation therewith, and wherein the control element acts during its rotation and during its movement onto the same member of the transmitters. A particularly simple apparatus results from a further development of the invention which includes a helically toothed gear or gears which during the rotation of the control element act onto the transmitters, and during the movement of the control element are longitudinally moved and thus define the rack element.

The invention assures a jerk-free starting and quick change from forward to rearward travel and vice versa, without causing the watercraft to go off course.

BRIEF DESCRIPTION OF THE DRAWINGS

The invention is discussed in connection with FIGS. 1 to 5.

FIG. 3 illustrates a diagram of examples for the position of the control unit with the associated thrust directions of the propellers.

DETAILED DESCRIPTION

The movement of a watercraft can be divided into two types, namely (1) longitudinal or transverse movement (shifting without rotation, traversing) and (2) rotation. The two types of movements can be superposed. The pivot point of the watercraft is the center of lateral resistance. In acceleration, the of-mass center plays a role, but the center of mass will always lie near the center of lateral resistance, so that the center of lateral resistance can with a normally sufficient exactness be considered as the pivot point. If a vehicle is supposed to be shifted without rotation, then in relationship to the center of lateral resistance the thrust forces must resolve without moments, namely the moments of the forces must cancel one another.

In the case of a symmetrical arrangement of the steerable propellers on opposite sides of the center plane of the watercraft, in front of or behind the center of lateral resistance and in parallel alignment with the center plane, there exists a moment-free application of force for forward and rearward travel. For all transverse movements (traversing) corresponding angles of traverse of the steerable propellers must be found.

It is possible with the invention to produce moment-free propeller thrust forces in every desired direction by a one-time departure of the steerable propellers from parallel alignment.

However, traversing in every desired direction alone is not sufficient for all maneuvers. Outside forces, such as wind and current and drag forces, which do not act exactly at the center of lateral resistance, or a shifting of the center of lateral resistance due to variable loading or trimming, can effect a rotation of the watercraft, which must be compensated. Thus, it must be possible to superpose traversing with rotation.

A torque superposed on the traversing force can be produced by rotating the thrust forces against one another out of their traversing direction. The available traversing force thereby changes. A right traversing plus right rotation of the thrust forces against one another results for example in a reinforced traversing plus turning to the right of the ship. A right traversing plus left rotation against one another results in a reduced traversing plus left rotation. The traversing can thereby be reduced so much that rotation takes place about one point. This is the only possibility for a pure rotation about one point.

The following functions can be carried out with the invention:

Synchronous control of the parallel aligned steerable propellers through 360°.

Adjustment of the steerable propellers from parallel alignment to traversing position.

Synchronous control of the steerable propellers in traversing position through 360°.

Superposing a rotary movement upon the traversing movement through an opposing adjustment of the propellers (steering device detuning).

Figure 1:
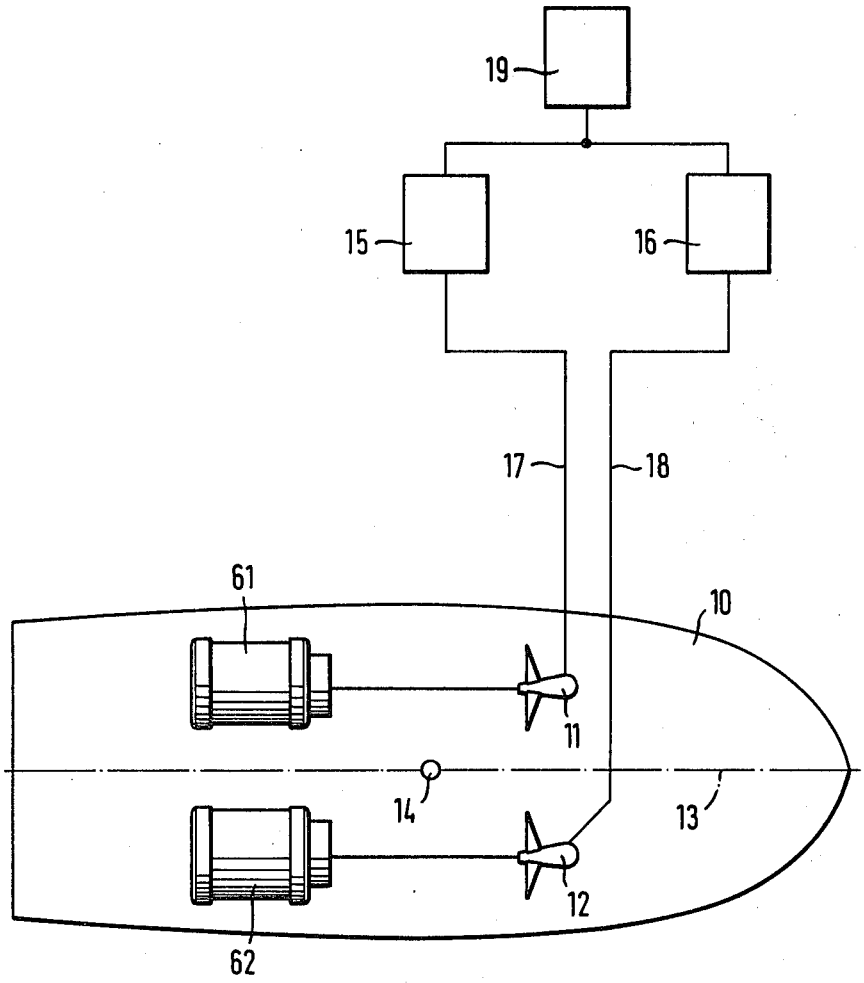
FIG. 1 schematically illustrates a watercraft to which the invention is applied.

FIG. 1 schematically illustrates a watercraft 10 with two steerable propellers 11, 12, which form a pair and are arranged symmetrically on opposite sides of the center plane 13 of the watercraft. This center plane extends through the center of lateral resistance 14. The steerable propellers are here located under the hull in front of the center of lateral resistance, but they may also lie therebehind. The propellers are driven by one motor or by respective motors 61, 62. The steerable propellers are pivotable each about a respective vertical axis (not shown) and are drivable for such pivoting. The use of servomotors or the like for said pivoting drive is known, so that it is sufficient to schematically indicate the steerable propellers, as in FIG. 1. The pivoting of the steerable propellers is done by means of a remote control for maneuvering the watercraft. Said remote control includes a control unit 19 and two transmitters, which transmitters are in the present example electrical function generators (rotational position signaling devices) 15, 16. Said function generators act through a line system 17, 18 to control conventional servomotors (not shown) which in turn steer the steerable propellers. The electrical function generators may also be adjustable resistors or potentiometers and may also be of an inductive or capacitive type. The remote control of the pivoting of the steering propellers may also be hydraulic or pneumatic. The elements for all of these controls are known.

Figure 2:
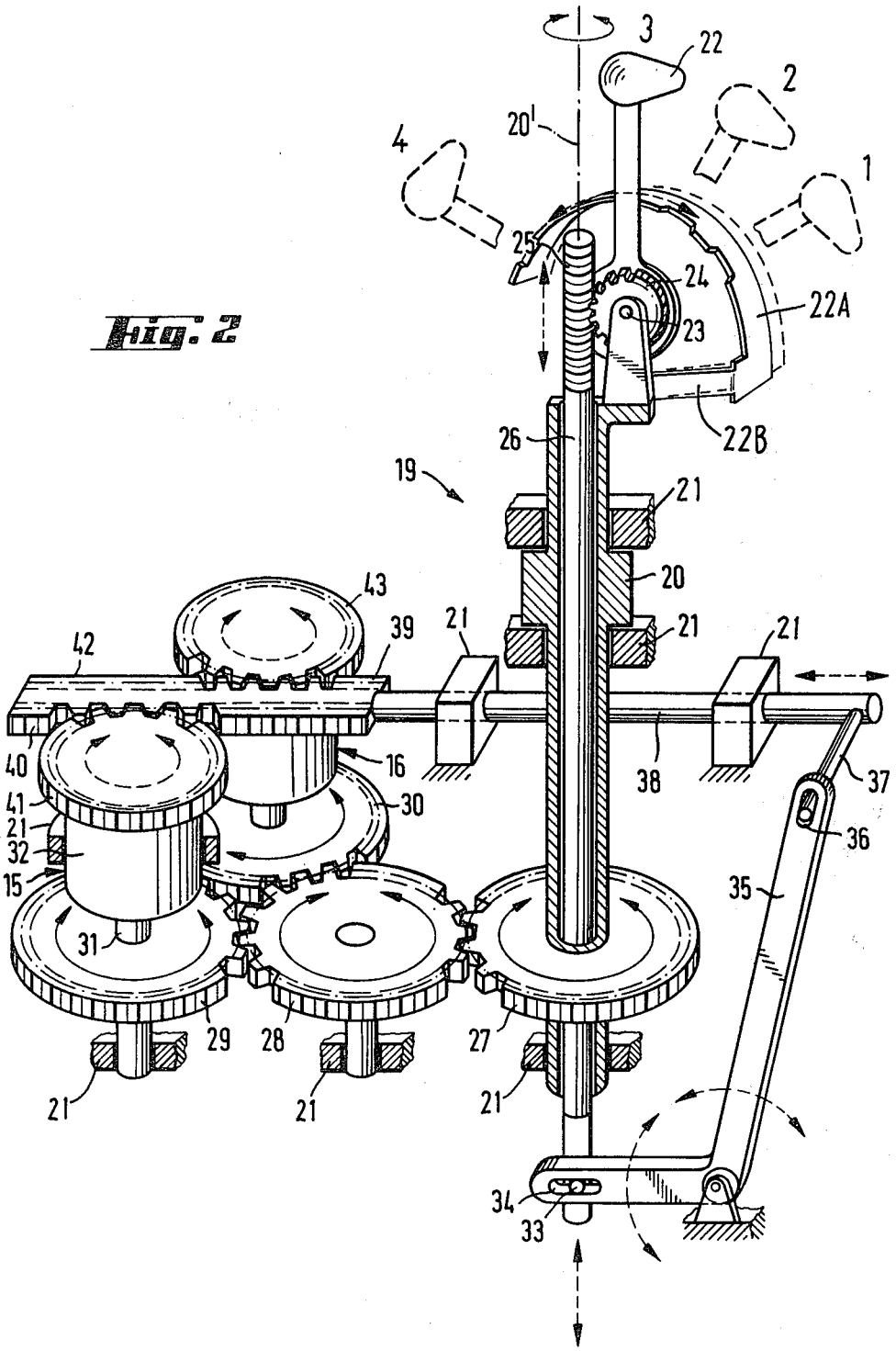
FIG. 2 schematically illustrates one exemplary embodiment of the invention, including the control unit, the transmitters and the gear train therebetween.

FIG. 2 illustrates a control unit 19, which acts on the transmitters, in this case the electrical function generators 15, 16. A lever 22 is supported rotatably about a horizontal axis 23 at the upper end on a hollow vertical shaft 20, which shaft is supported rotatably, but not longitudinally movably, in a frame 21. A pinion 24 is connected coaxially with the lever, which pinion engages a cylindrical rack 25. The cylindrical rack is positioned at the upper end of a rod 26, which extends coaxially up through the hollow vertical shaft 20 and can rotate with respect to same and can move longitudinally with respect to same. The lever 22 can assume two end positions 1, 4 and two locking positions 2, 3 between said end positions, for which positions detents may be provided. The elements for the detents are known and therefore need not be illustrated.

FIG. 2 shows but one example in which detents are formed by teeth on a sector 22A resiliently mounted by a leaf spring member 22B on the rotatable hollow shaft 20 to permit manual pivoting of lever 22 from one to the next of positions 1, 2, 3, 4 positively defined between the teeth on sector 22A. Alternately, axially spaced grooves on the rod 26 may coact with an opposed springloaded ball on the hollow shaft 20 to form a detent assembly not shown. The hereafter described FIG. 4 and FIG. 5 embodiments are preferably provided with suitable detent assemblies not shown.

A gear 27 is fixed on the lower end of the hollow vertical shaft 20 and engages an intermediate gear 28, which in turn mates with two gears 29, 30. The gears 28, 29, 30 are rotatably supported on the frame 21. A first member 31 of each of the function generators 15, 16 is connected coaxially to and fixed for rotation with a respective one of the gears 29, 30. The second member 32 of each of the function generators 15, 16 cooperates with the corresponding first member 31 and is supported rotatably, but not longitudinally movably, in the frame 21. The first member 31 may be a brush and the second member 32 may be a spool of an electrical resistor or potentiometer.

The lower end of the rod 26 carries a cross pin 33 which engages a slot 34 provided in one end of a two-arm lever 35. A slot 36 is also provided in the other end of said lever, into which slot engages a pin 37 carried at one end of an operating rod 38. The operating rod is supported longitudinally movably, but not rotatably, in the frame 21. A two-sided rack 39 is provided at the other end of the operating rod 38. A first tooth system 40 on one side of the rack engages a gear 41 connected to the second member 32 of the function generator 15. A second tooth system 42 on the other side of the rack engages a gear 43 connected to the second member of the function generator 16.

If the hollow vertical shaft 20 is rotated by the lever 22, then the first members 31 of the function generators 15, 16 are rotated synchronously in the same direction of rotation by the gear 27, the intermediate gear 28 and the gears 29, 30. If the lever 22 is pivoted about the horizontal axis 23, then the second members 32 of the function generators 15, 16 are rotated in opposite directions by the elements 26, 35, 38, 39, 40, 41, 42, 43.

FIG. 3 schematically illustrates some control functions, which can be carried out with the above-described control unit 19. The column 100 identifies the lines in which the control schedules are described. Column 101 indicates the angular position of the lever 22 during its rotation about the vertical axis 20'; column 102 identifies the detented positions of the lever 22 during its pivoting about the horizontal axis 23. Column 103 symbolizes the position of the lever 22 and columns 104 and 105 identify the direction of the propeller thrusts at the corresponding positions of the steerable propellers.

Line 111: If the lever 22 is not rotated from its rotational reset position (position 0°) and is in the end detent position 1, then the steerable propellers are directed parallel and straight ahead.

Line 112: If the lever 22 is rotated about the vertical axis 20', then the steerable propellers are synchronously pivoted and the ship is maneuvered in the usual manner.

Line 113: If the lever 22 is at rotational position 0° and in the detent position 2, the steerable propellers are in the initial position for traversing (in this case traversing forwardly).

Line 114: A rotation of the lever 22 about vertical axis 20' while in detent position 2 causes, due to the rack, a traversing in a desired direction, for example traversing at 45° to the right of forwardly.

Line 115: As in line 114, but traversing is 90° to the right.

Line 116: A pivoting of the lever 22 from the detent position effects a reciprocal "detuning" of the function generators 15, 16 by means of the rack 39 and causes superposition of a rotation on the traversing, for example traversing 45° to the right forwardly with a superposed rotation to the left.

Line 117: As in line 116, but traversing is 90° to the right with a superposed rotation to the left.

Line 118: In detent position 3 the propellers are positioned to oppose one another; in spite of the energization of the propellers, there is thus no movement of the ship.

Line 119: With the lever 22 rotated about vertical axis 20' to its 180° position and pivoted about horizontal axis 23 to its detent position 2, ship movement is slightly rearward.

Line 120: If from the line 111 position one pivots the lever 22 about the horizontal axis 23 to detent position 4, then the steerable propellers pivot in opposite directions into their parallel full rearward position. The same would also be achieved by rotating the lever 22 about the vertical axis 20' through 180° from the 0° position (line 111), but during the resulting pivoting in parallel of the steerable propellers a net lateral thrust is produced, which may possibly be detrimental.

Figure 4:
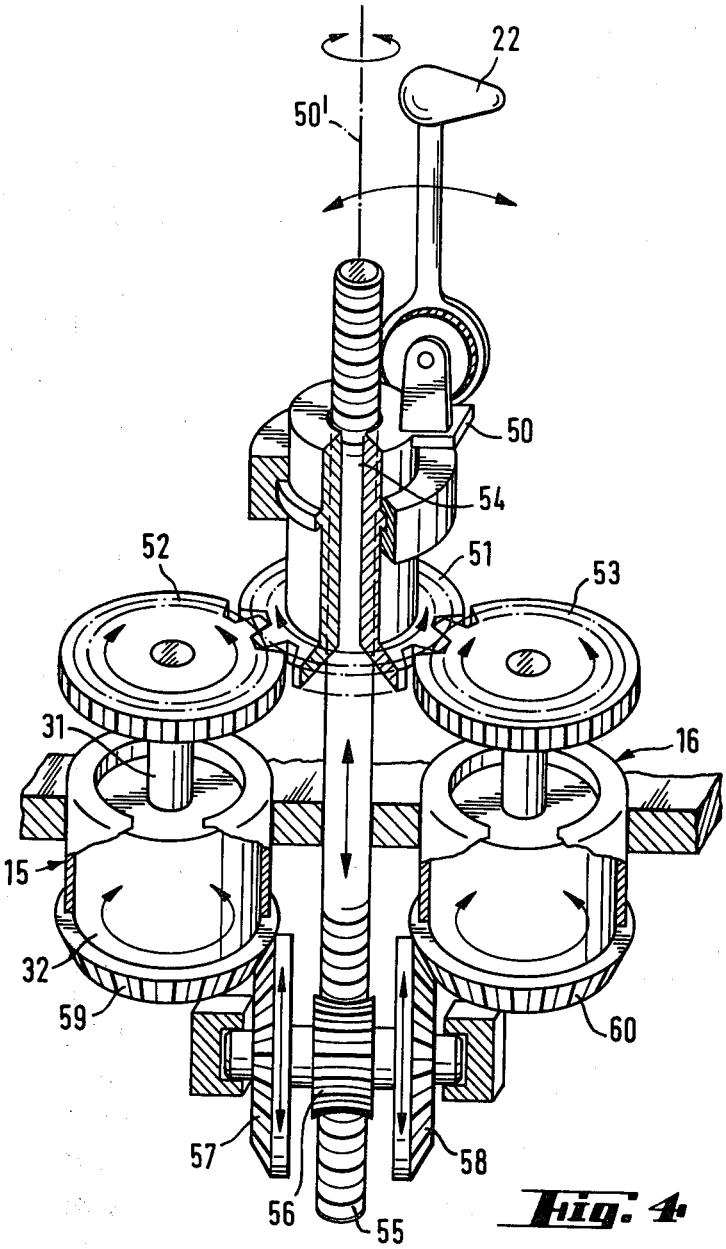
FIG. 4 schematically illustrates a different exemplary embodiment of the invention.

FIG. 4 illustrates a further embodiment of the invention, which may be generally similar to the FIG. 2 embodiment except for the differences described below. In the FIG. 4 embodiment, the gear 51 positioned on the vertical shaft 50 engages the gears 52, 53, which drive the respective first members 31 of the corresponding function generators 15, 16. The rod 54 supported coaxially of the vertical shaft 50 is provided at its lower end with a second cylindrical rack 55, which mates with a pinion 56 of hyperboloid form. The pinion may also have a different suitable shape. Two bevel gears 57, 58 are fixed on the same shaft with the pinion, for rotation with same, which bevel gears engage bevel gears 59, 60 connected to the respective second members 32 of the corresponding function generators 15, 16. The operation of the FIG. 4 control unit can be taken directly from the foregoing description of FIG. 2.

Figure 5:
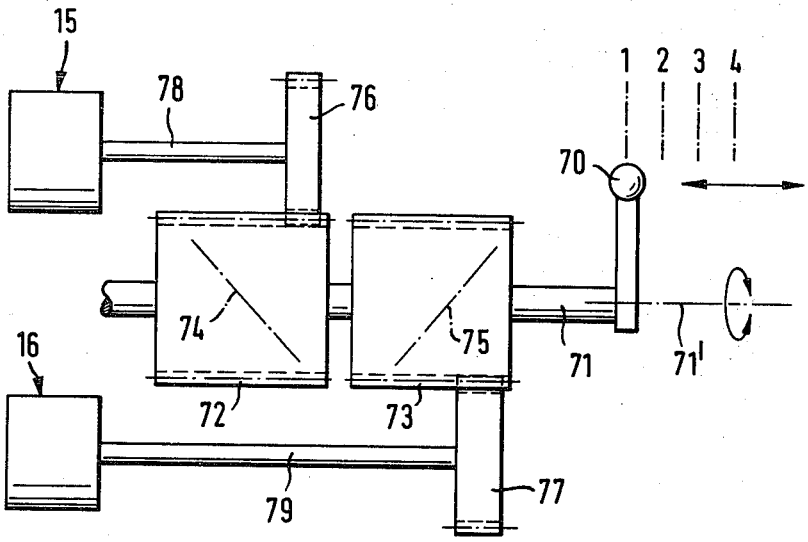
FIG. 5 schematically illustrates a further exemplary embodiment.

A further embodiment of the invention is schematically illustrated in FIG. 5. A lever 70, which corresponds with the lever 22 of the above-described exemplary embodiments, is fixed at the end of a shaft 71 supported rotatably and longitudinally movably on a frame (not shown). The elements of such a support are known and therefore not illustrated. Two helically toothed gears 72, 73 are fixed on the shaft, the teeth of which gears 72, 73 have oppositely directed angles of tooth indicated by respective dash-dotted lines 74, 75. The helically toothed gears mate with countergears 76, 77, which are coupled each to a first member of the corresponding one of the function generators 15, 16, for example through respective shafts 78, 79. The second members of the function generators are fixed on the above-mentioned frame (not shown). If the lever 70 and shaft 71 are pivoted about the axis 71', then the function generators 15, 16 are adjusted synchronously in the same direction of rotation. The steerable propellers 11, 12 are rotated in parallel and in the same direction (synchronously). If the lever 70 and shaft 71 are axially moved from position 1 to position 2, 3 or 4, then the countergears 76, 77 are rotated oppositely due to the differing angles of tooth 74, 75 so that the function generators are "detuned", as is illustrated in FIG. 3, lines 113 to 119.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An apparatus for driving and controlling a watercraft, comprising:

at least one pair of steerable propellers, the steerable propellers of each pair being located substantially symmetrically on opposite sides of the center plane of the watercraft, said center plane extending through the center of lateral resistance of the watercraft, said steerable propellers each being drivable to produce a directed thrust upon the watercraft for moving the latter;

a single control element for carrying out control movements in two degrees of freedom in relation to a common axis;

transmitters responsive to positioning of said control element to direct the thrust of respective ones of said steerable propellers;

means for presetting the locations of at least first and second fixed alternatively selectable positions of said control element in one of said two degrees of freedom;

means establishing a first path of actuation from said single control element to said transmitters and responsive to movement of said control element in the other said degree of freedom for pivoting of said steerable propellers of each pair in the same angular direction by the same angular amount;

the propellers of each pair having thrust directions which are parallel in said first fixed position of said control element, independent of pivoting of the steerable propellers by said movement of said control element in said second degree of freedom, for normal driving and maneuvering of said watercraft by said movement of said control element in said second degree of freedom;

means establishing a second path of actuation from said single control element to said transmitters and responsive to movement of said control element in said one degree of freedom from said first fixed position to said second fixed position for pivoting of said steerable propellers of each pair in opposite angular directions out of parallelism with each by a preselected angular amount for traversing movement of the watercraft in a direction changeable by movement of said control element in said second degree of freedom, said transmitters being electrical function generators, each comprising first and second members relatively rotationally movable to produce an electrical output for said directing of propeller thrust, the controll element in one degree of freedom acting on said first members and in its other degree of freedom acting on said second members.

2. An apparatus for driving and controlling a watercraft, comprising:

at least one pair of steerable propellers, the steerable propellers of each pair being located substantially symmetrically on opposite sides of the center plane of the watercraft, said center plane extending through the center of lateral resistance of the watercraft, said steerable propellers each being drivable to produce a directed thrust upon the watercraft for moving the latter;

a single control element for carrying out control movements in two degrees of freedom in relation to a common axis;

transmitters responsive to positioning of said control element to direct the thrust of respective ones of said steerable propellers;

means for presetting the locations of at least first and second fixed alternatively selectable positions of said control element in one of said two degrees of freedom;

means establishing a first path of actuation from said single control element to said transmitters and responsive to movement of said control element in the other said degree of freedom for pivoting of said steerable propellers of each pair in the same angular direction by the same angular amount;

the propellers of each pair having thrust directions which are parallel in said first fixed position of said control element, independent of pivoting of the steerable propellers by said movement of said control element in said second degree of freedom, for normal driving and maneuvering of said watercraft by said movement of said control element in said second degree of freedom;

means establishing a second path of actuation from said single control element to said transmitters and responsive to movement of said control element in said one degree of freedom from said first fixed position to said second fixed position for pivoting of said steerable propellers of each pair in opposite angular directions out of parallelism with each by a preselected angular amount for traversing movement of the watercraft in a direction changeable by movement of said control element in said second degree of freedom, said transmitters each comprising first and second members which are movable rotatably relative to one another to direct the thrust of the corresponding steerable propeller, the single control element acting during its movement in both its degrees of freedom onto said first members of the transmitters of both propellers but through independent mechanical motion transfer modes defining said first and second paths of actuation.

3. An apparatus for driving and controlling a watercraft, comprising:

at least one pair of steerable propellers, the steerable propellers of each pair being located substantially symmetrically on opposite sides of the center plane of the watercraft, said center plane extending through the center of lateral resistance of the watercraft, said steerable propellers each being drivable to produce a directed thrust upon the watercraft for moving the latter;

a single control element for carrying out control movements in two degrees of freedom in relation to a common axis;

transmitters responsive to positioning of said control element to direct the thrust of respective ones of said steerable propellers;

means for presetting the locations of at least first and second fixed alternatively selectable positions of said control element in one of said two degrees of freedom;

means establishing a first path of actuation from said single control element to said transmitters and responsive to movement of said control element in the other said degree of freedom for pivoting of said steerable propellers of each pair in the same angular direction by the same angular amount;

the propellers of each pair having thrust directions which are parallel in said first fixed position of said control element, independent of pivoting of the steerable propellers by said movement of said control element in said second degree of freedom, for normal driving and maneuvering of said watercraft by said movement of said control element in said second degree of freedom;

means establishing a second path of actuation from said single control element to said transmitters and responsive to movement of said control element in said one degree of freedom from said first fixed position to said second fixed position for pivoting of said steerable propellers of each pair in opposite angular directions out of parallelism with each by a preselected angular amount for traversing movement of the watercraft in a direction changeable by movement of said control element in said second degree of freedom, said transmitters each comprising two members movable rotatably relative to one another to direct the thrust of the corresponding steerable propeller, said first path establishing means including a train of gears through which the control element acts during control movement in the other degree of freedom onto one member of each of the transmitters, and said second path establishing means including a rack element through which the control element acts during control movement in the one degree of freedom onto the other member of each of the transmitters.

4. Apparatus according to claim 3, in which said control element is a lever, said first path establishing means comprising a hollow member mounted for rotation about said axis and pivotally supporting said lever about a pivot axis transverse to and offset from the first mentioned axis, such that said lever is displaceable in its entirety to rotate said hollow member about said first mentioned axis, said gear train including a first gear fixed on said rotatable hollow member and respective driven gears on said one members of said transmitters and rotatable in the same direction as each other by rotative movement of said hollow member, said second path establishing means including an axially displaceable member sleeved within said hollow member for relative axial and rotatable motion therebetween, means operatively connectint the pivotally mounted end of said lever with said axially displaceable member for converting pivoting of said lever about its said transverse axis to corresponding axial movement of said axially displaceable member, said rack element being operatively connected to said axially displaceable member for reciprocating movement therewith and further gears operatively connecting said rack element with said other member of each of said transmitters for simultaneously rotating said other members in opposite rotative directions.

5. An apparatus for driving and controlling a watercraft, comprising:

at least one pair of steerable propellers, the steerable propellers of each pair being located substantially symmetrically on opposite sides of the center plane of the watercraft, said center plane extending through the center of lateral resistance of the watercraft, said steerable propellers each being drivable to produce a directed thrust upon the watercraft for moving the latter;

a single control element for carrying out control movements in two degrees of freedom in relation to a common axis;

transmitters responsive to positioning of said control element to direct the thrust of respective ones of said steerable propellers;

means for presetting the locations of at least first and second fixed alternatively selectable positions of said control element in one of said two degrees of freedom;

means establishing a first path of actuation from said single control element to said transmitters and responsive to movement of said control element in the other said degree of freedom for pivoting of said steerable propellers of each pair in the same angular direction by the same angular amount;

the propellers of each pair having thrust directions which are parallel in said first fixed position of said control element, independent of pivoting of the steerable propellers by said movement of said control element in said second degree of freedom, for normal driving and maneuvering of said watercraft by said movement of said control element in said second degree of freedom;

means establishing a second path of actuation from said single control element to said transmitters and responsive to movement of said control element in said one degree of freedom from said first fixed position to said second fixed position for pivoting of said steerable propellers of each pair in opposite angular directions out of parallelism wih each by a preselected angular amount for traversing movement of the watercraft in a direction changeable by movement of said control element in said second degree of freedom, first helically toothed gear means fixed to said control element for rotation and reciprocation therewith, said rotation and reciprocation defining said one and other degrees of freedom of said control element, said transmitters each having further helically toothed gear means engageable with said first-mentioned helically toothed gear means, the helix angles on said gear means being such that reciprocation of said control element and first-mentioned gear means moves the latter axially with respect to the further gear means of said transmitters and through relative sliding motion of the teeth of said first mentioned and further gear means results in actuation of said transmitters to pivot said steerable propellers in opposite angular directions, pivoting of said control element resulting in rotation of said further gear means of said transmitters and in pivoting of said steerable propellers in the same angular direction, said first-mentioned and further gear means comprising said first and second path establishing means.

* * * * *